US008403537B2

(12) United States Patent
Miridonov et al.

(10) Patent No.: US 8,403,537 B2
(45) Date of Patent: Mar. 26, 2013

(54) LIGHTING APPARATUS

(76) Inventors: Alexei Miridonov, Ensenada (MX); Alejandro De Santos, Ensenada (MX); Rafael De Santos, Ensenada (MX); Kuotaro Sanay, El Cajon, CA (US)

( * ) Notice: Subject to any disclaimer, the term of this patent is extended or adjusted under 35 U.S.C. 154(b) by 56 days.

(21) Appl. No.: 13/217,874

(22) Filed: Aug. 25, 2011

(65) Prior Publication Data

US 2012/0051062 A1 Mar. 1, 2012

Related U.S. Application Data

(60) Provisional application No. 61/379,355, filed on Sep. 1, 2010.

(51) Int. Cl.
*F21V 7/05* (2006.01)

(52) U.S. Cl. ..... 362/297; 362/153.1

(58) Field of Classification Search ..... 362/153.1, 362/218, 241, 249.02, 294, 297, 298
See application file for complete search history.

(56) References Cited

U.S. PATENT DOCUMENTS

2007/0086196 A1* 4/2007 Wong ..... 362/294
2010/0103668 A1* 4/2010 Lueken et al. ..... 362/294

* cited by examiner

*Primary Examiner* — David V Bruce
(74) *Attorney, Agent, or Firm* — Leason Ellis LLP

(57) ABSTRACT

A lighting apparatus has a reflector of a specially designed shape and a plurality of light sources such as LEDs disposed inside the reflector whereby a portion of light emitted by the light sources is received by the reflector surface and directed so as to provide a uniform and wide illumination pattern over the illuminated surface in indoors or outdoors applications such as roadway illumination.

11 Claims, 16 Drawing Sheets

LIGHTING APPARATUS

CROSS-REFERENCE TO RELATED APPLICATIONS

This patent application claims the benefit of U.S. Provisional Patent Application Ser. No. 61/379,355, filed Sep. 1, 2010, which is hereby incorporated by reference in its entirety herein.

TECHNICAL FIELD

The present invention is in the technical field of lighting apparatus. More particularly, the present invention is in the technical field of lighting apparatus for general indoors or outdoors illumination and methods for using light emitting diodes (LEDs) or other light sources to generate an illumination pattern required by the application in which the lighting apparatus is used.

BACKGROUND

Since LEDs (light emitting diodes) have reached high luminous efficacy and the ability to generate high luminous flux, the interest for their use in indoor and outdoor lighting, such as street lighting, has grown very fast. One of the major challenges in using LEDs in applications such as street lighting, is the design of an optical system necessary to achieve an efficient illumination and comply with all requirements and regulations. Lighting fixtures based on LEDs can be very efficient if special attention is paid to the optical system. In order to achieve an efficient illumination over the illuminated surface or area, a uniform light pattern must be generated by the lighting fixture preventing excessive light in areas near the lighting fixture commonly known as hot spots.

Most of the lighting fixtures based on LEDs for street lighting for example, use complex refractive (lenses) or reflective (reflectors) secondary optics that are made for a specific type of LED to achieve a uniform illumination pattern. These secondary optics are specially designed in order to be able to direct light emitted by the LED so as to generate a complex illumination pattern. Commonly, complex secondary optics are used in arrays where each LED has its own individual lens or reflector. One of the major drawbacks of this type of optics is that they usually are limited to only one type of LED from a specific manufacturer. This is because LEDs from each manufacturer are physically different, and many factors such as light emitting area, size and mechanical properties of the LED have to be taken into account when designing this type of optics. This means that once the optical system is developed, a lighting fixture designer will be unable to change from one type of LED to another without redesigning the whole optical system. Moreover, it is impossible to design this type of secondary optics for some LEDs in the market due to their large emitting area which would require a very big lens or reflector making the solution impractical.

On the other hand, simple secondary optics for collimating light in only one direction are easier to develop and are widely available in the market for many types of LEDs. Secondary optics of this type are gaining popularity in applications such as spotlights, downlights, flashlights and many other, where it is not required to generate a complex illumination pattern. In street lighting applications, simple secondary optics can be used in special configurations with different aiming angles for each lens or reflector or along with other type of light shaping method in order to provide an illumination pattern adequate for the application. This gives freedom to lighting fixture designers to use different types of LED by just changing the simple secondary optics without redesigning the main optical system.

SUMMARY

The present invention is a lighting apparatus for general indoors or outdoors illumination having a reflector of a specially designed shape and a plurality of light sources which can be LEDs to generate an illumination pattern for a specific application such as roadway illumination for example. Complete LED modules including a heatsink can be used in the lighting apparatus of the present invention. The reflector of the lighting apparatus of the present invention serves as a light shaping method to generate a wide and uniform illumination pattern making the lighting apparatus more efficient. One of the most evident applications of the lighting apparatus of the present invention is roadway illumination where a complex illumination pattern is required. The benefit of using a reflector described in this document is that it gives a possibility to use different types of light sources such as different LEDs from different manufacturers without having to change or redesign the reflector itself. This gives an advantage to lighting apparatus manufacturers to integrate new light sources to the existent optical design of the reflector reducing costs and development times.

DETAILED DESCRIPTION OF CERTAIN EMBODIMENTS

The present invention is directed to a lighting apparatus having a reflector and a plurality of light sources. The reflector is of a specially designed shape for receiving portion of the light emitted by light sources and directing received light in accordance with predefined illumination pattern. Mainly LEDs (light emitting diodes) can be used as light sources, however any other light emitting device, preferably with light distribution of lambertian type, can be implemented. Described below preferred embodiment has the ability to provide mechanical support for the light sources or complete assembled modules such as LED modules with printed circuit board and a heatsink. The technical characteristics, features and advantages of the present invention will become apparent in the following detailed description of the preferred embodiments with reference to the accompanying drawings. However, the drawings are provided for reference and illustration only and are not intended for limiting the scope of present invention.

Figure 1A:
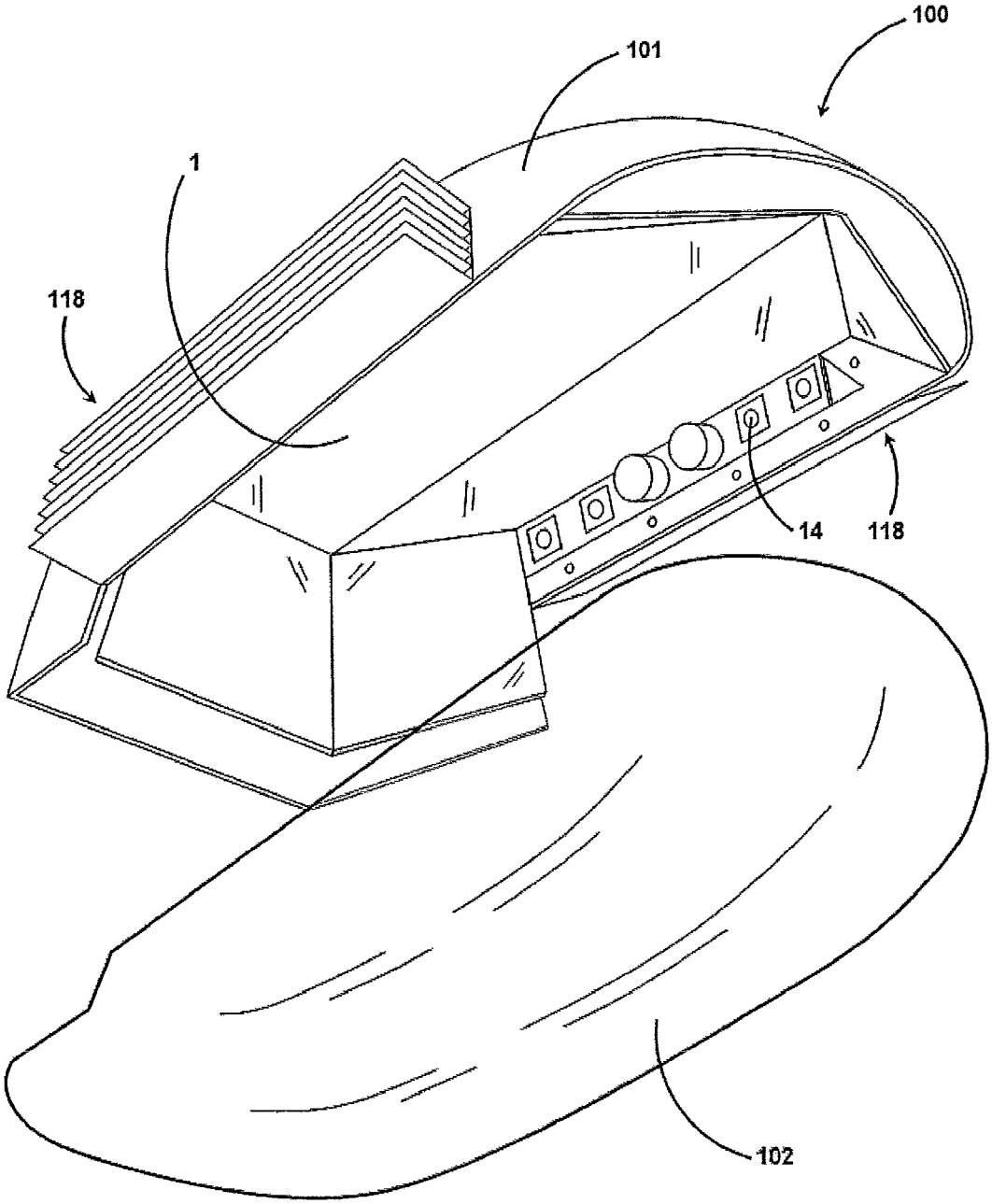
FIG. 1A is a bottom perspective view of the lighting apparatus of the present invention.

Turning first to FIG. 1A, an exemplary embodiment of lighting apparatus 100 of present invention is shown. A reflector 1 disposed inside an enclosure 101 in the upper half of the lighting apparatus 100 and is sealed from the bottom with a cover lens 102 positioned in the lower half of the lighting apparatus 100. Both enclosure 101 and cover lens 102 are for protecting light sources such as LEDs 14 and other internal components of the lighting apparatus 100 from impact, dust, humidity and other factors. Shown also, exemplary LED modules 118 are mounted on the enclosure 101 in a manner that LEDs 14 are positioned inside the enclosure 101 and inside the reflector 1 of the lighting apparatus 100. In FIG. 1A, the enclosure 101 is a one piece molded ABS (Acrylonitrile Butadiene Styrene) plastic made by injection molding for reducing overall weight of the lighting apparatus 100 but if preferred, it can also be manufactured from aluminum or other metal by die-casting. Cover lens 102 can be manufactured by injection molding and must be of a light transmitting material such as optical grade acrylic (PMMA) or UV stabilized polycarbonate.

Figure 1B:
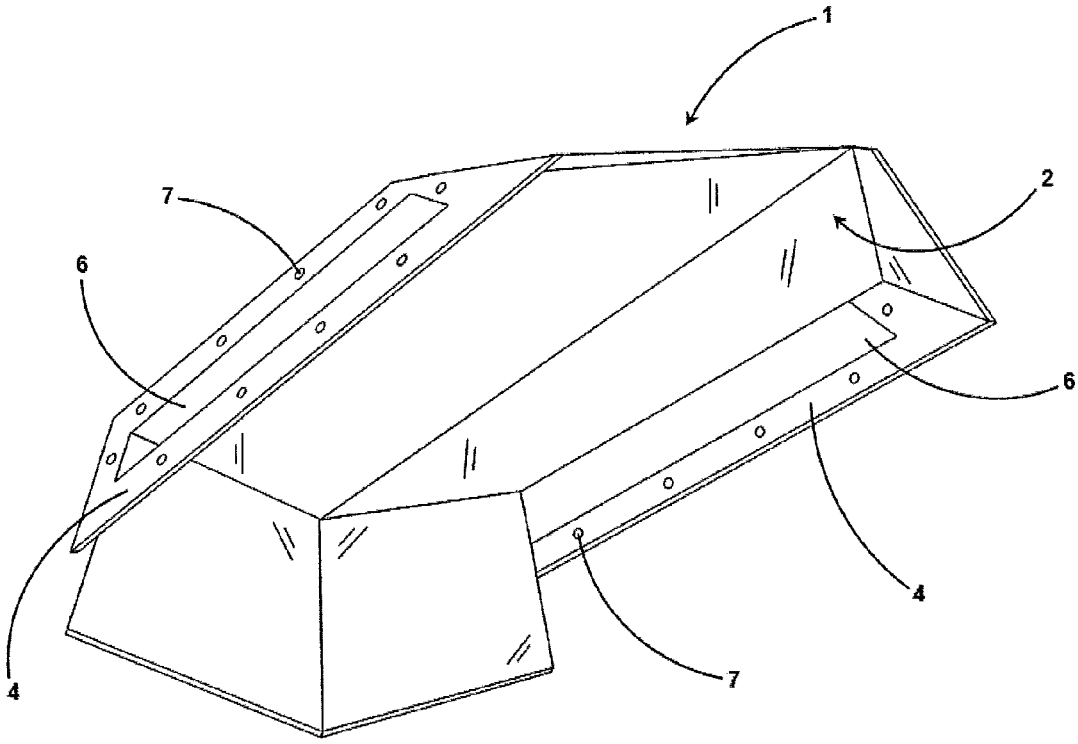
FIG. 1B is a bottom perspective view of the reflector embodiment for the lighting apparatus of the present invention shown in FIG. 1A.

In FIG. 1B, an exemplary embodiment of a reflector 1 for the lighting apparatus 100 (shown in FIG. 1A) of present invention is shown. The internal surface 2 of the reflector body 1 is of a specially designed shape and has light reflective properties in order to reflect and direct light emitted from light sources described later in this document, so as to form a wide and uniform illumination pattern over the illuminated surface underneath the lighting apparatus. The illumination pattern produced by the lighting apparatus using said reflector body 1 is suitable for indoor or outdoor applications including roadway illumination. In case of roadway illumination, two types of light distributions, Type II and III, are easily achievable using the configuration of the reflector body 1 described in this document. The reflector 1 for the lighting apparatus 100 (FIG. 1A) can be manufactured out of plastic by injection molding or by stamping using flat metal sheets. Light reflective properties of the internal surface 2 of the reflector body 1 can be achieved by applying a thin aluminum coat by sputter deposition for molded plastic or using polished metal in case that flat metal sheets are used.

FIG. 1B also shows two sidewalls 4 adjacent to the reflector body 1, where sidewalls 4 are flat. Sidewalls 4 can be used to attach light sources 3 (shown in FIGS. 6 to 8) inside the reflector body 1, providing mechanical support for said light sources. Each of the sidewalls 4 may have one or more openings 6 of an arbitrary form to insert at least one light source 3 (FIGS. 6 to 8) through each sidewall 4 into the reflector body 1 as described later in this document. Sidewalls 4 may also have multiple perforations 7 for attaching said light sources or complete LED modules 118 (shown in FIG. 10) with screws or using other methods. Sidewalls 4 may form part of the reflector body 1 being physically joined to the reflector body 1 as shown in FIG. 1B or, be a part of a separate embodiment such as an enclosure 101 of the lighting apparatus 100 as shown in FIG. 1A.

Figure 2:
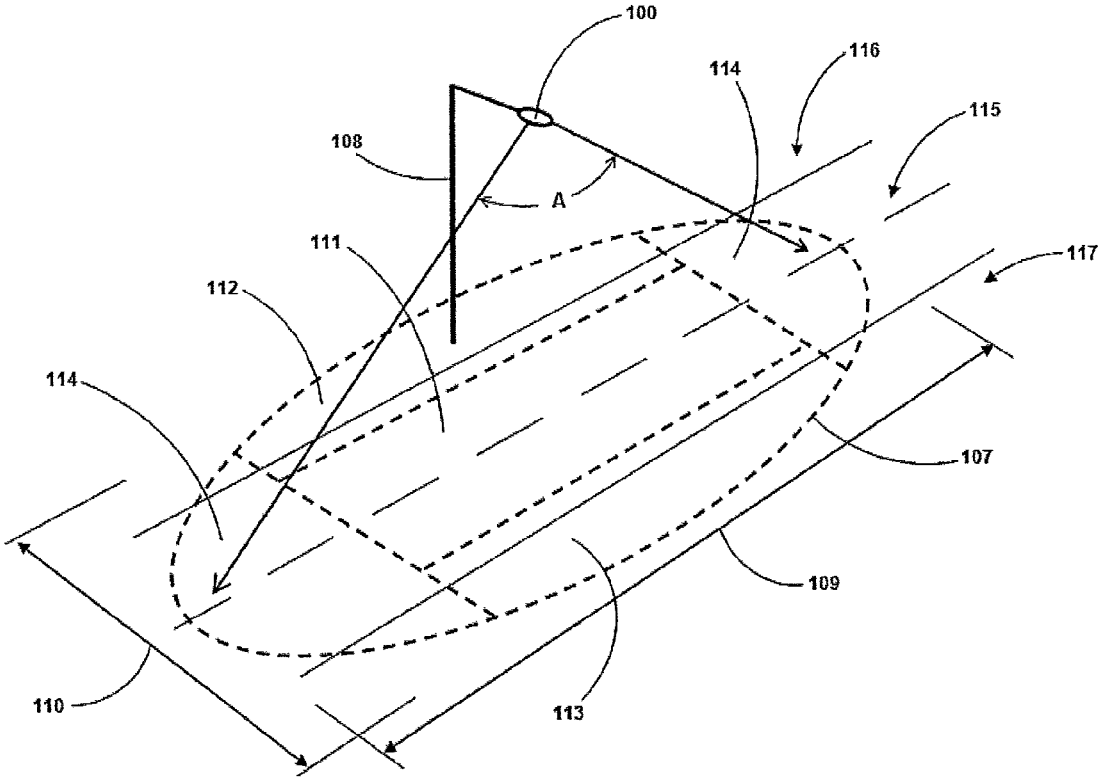
FIG. 2 is a top perspective view of the illumination pattern for roadway illumination applications generated by the lighting apparatus of the present invention.

In FIG. 2, a typical application of the lighting apparatus 100 for roadway illumination is shown. A lighting apparatus 100 installed on a conventional pole 108 produces a wide illumination pattern 107 illuminating the road surface 115, the near sidewalk 116 and the opposite sidewalk 117, whereby said illumination pattern 107 has longitudinal range 109 and transversal range 110 and whereby said illumination pattern comprises a first zone 111 located underneath the lighting apparatus 100 so as to illuminate the road surface 115 near the lighting apparatus 100, a second zone 112 located behind the lighting apparatus 100 so as to illuminate the near sidewalk 116, a third zone 113 located in front of the lighting apparatus 100 so as to illuminate the opposite sidewalk 117 and a fourth zone 114 so as to illuminate the road surface 115 far from the lighting apparatus 100.

Figure 3:
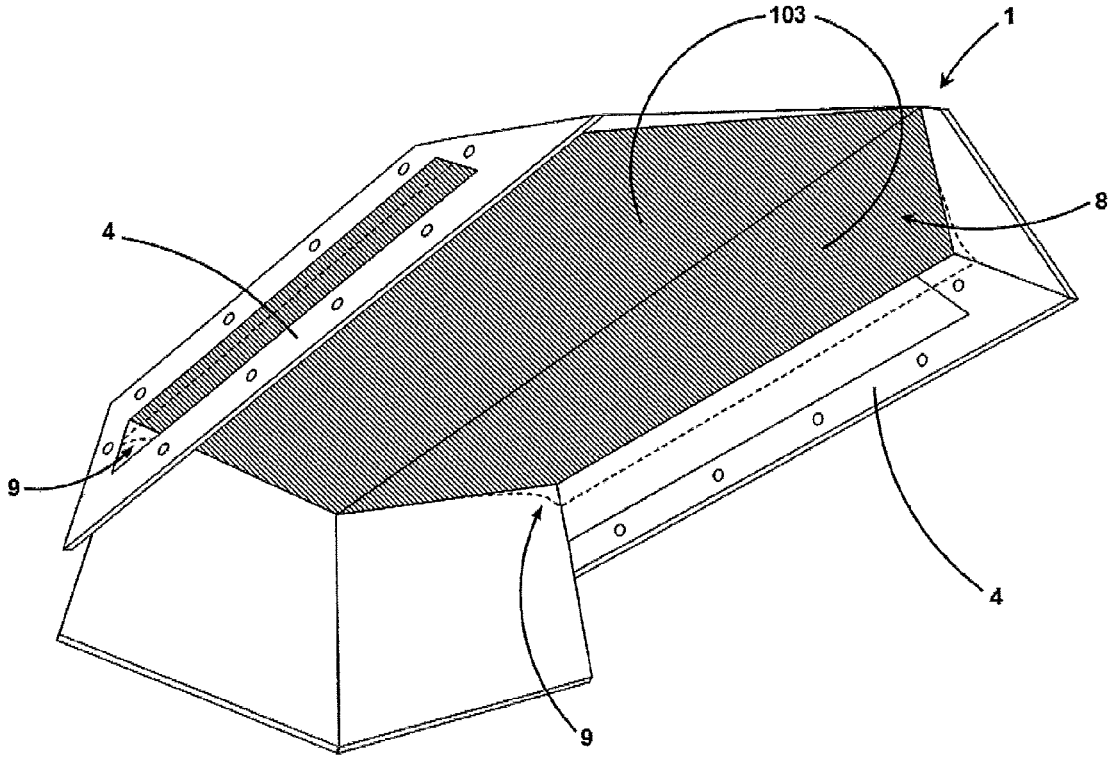
FIG. 3 is a bottom perspective view of the reflector embodiment for the lighting apparatus of the present invention whereby the upper section of the reflector body is shown.
Figure 4:
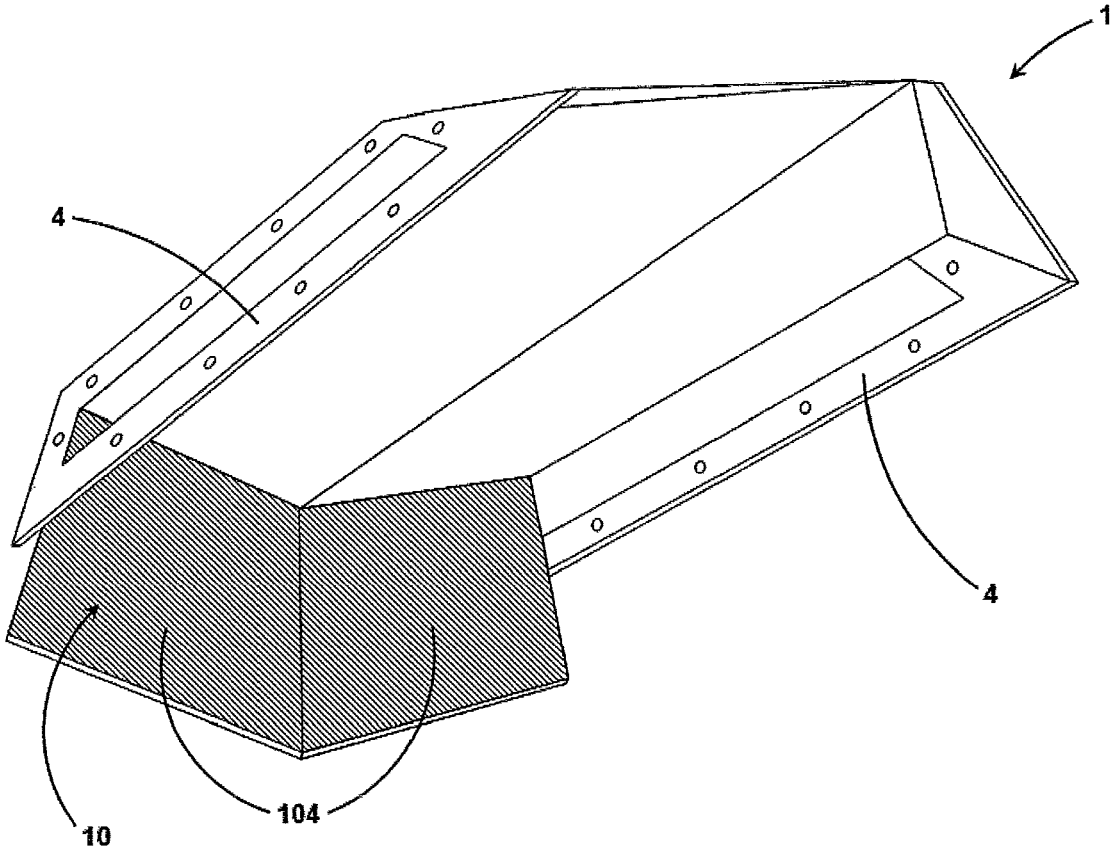
FIG. 4 is a bottom perspective view of the reflector embodiment for the lighting apparatus of the present invention whereby the rear section of the reflector body is shown.
Figure 5:
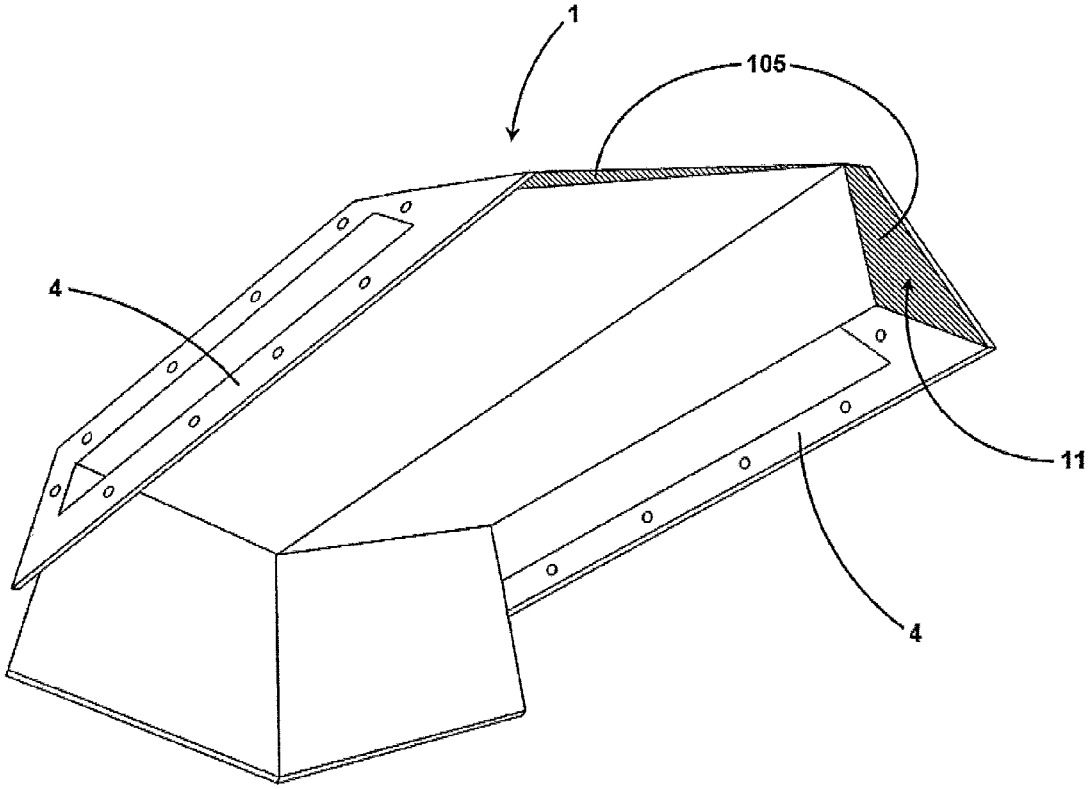
FIG. 5 is a bottom perspective view of the reflector embodiment for the lighting apparatus of the present invention whereby the front section of the reflector body is shown.

Regarding FIGS. 3 to 5, the internal surface 2 (indicated in FIG. 1B) of the reflector body 1 comprises an upper section 8 formed with two flat sheets 103 positioned at the top of the reflector body 1 between the two sidewalls 4, whereby the reflective faces of flat sheets 103 of the upper section 8 are facing downwards. The upper section 8 can also be formed with two sheets 103 that may have a small curvature 9 of parabolic shape whereby said curvature 9 is adjacent to sidewalls 4. The internal surface 2 (FIG. 1B) of the reflector body 1 also comprises a rear section 10 formed with two flat sheets 104 positioned at the rear side of the reflector body 1 between the two sidewalls 4 and under the upper section 8, where the reflective faces of flat sheets 104 of the rear section 10 are facing towards the front side of the reflector body 1. The internal surface 2 (FIG. 1B) of the reflector body 1 also comprises a front section 11 formed with two flat sheets 105 positioned at the front side of the reflector body 1 between the two sidewalls 4 and under the upper section 8, where the reflective faces of flat sheets 105 of the front section 11 are facing towards the rear side of the reflector body 1.

Figure 6:
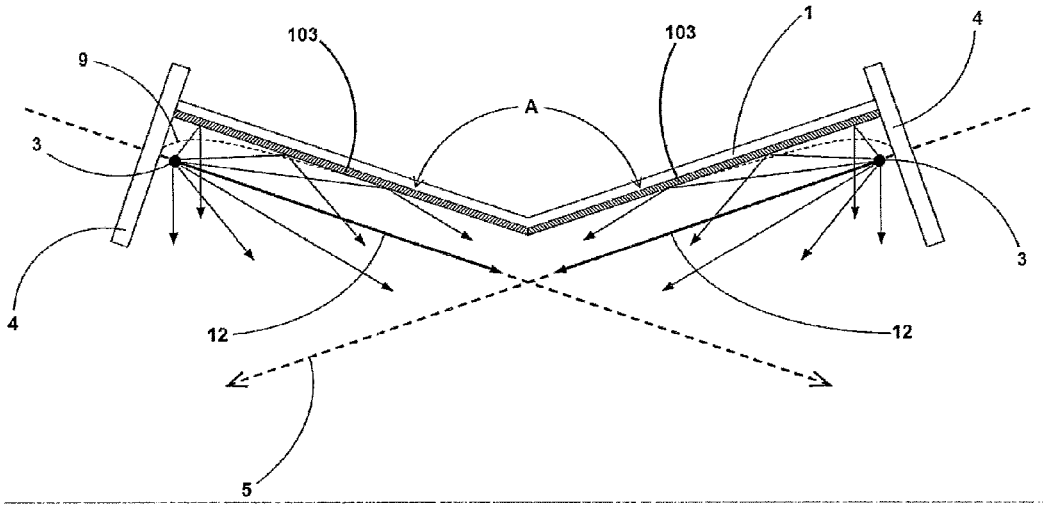
FIG. 6 is a cross-sectional view of the reflector body of the lighting apparatus of the present invention.
Figure 7:
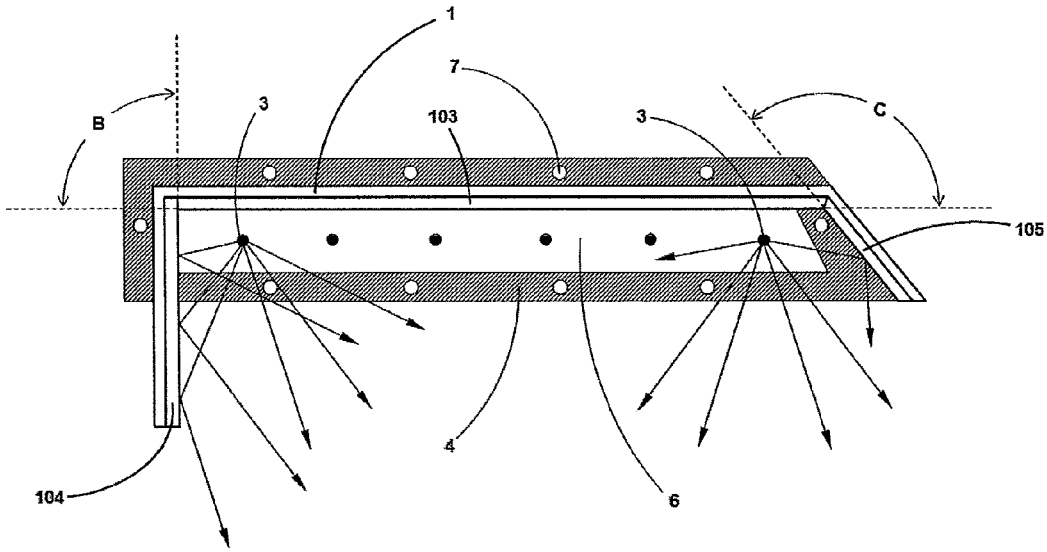
FIG. 7 is a side view of the longitudinal section of the reflector body of the lighting apparatus of the present invention.
Figure 8:
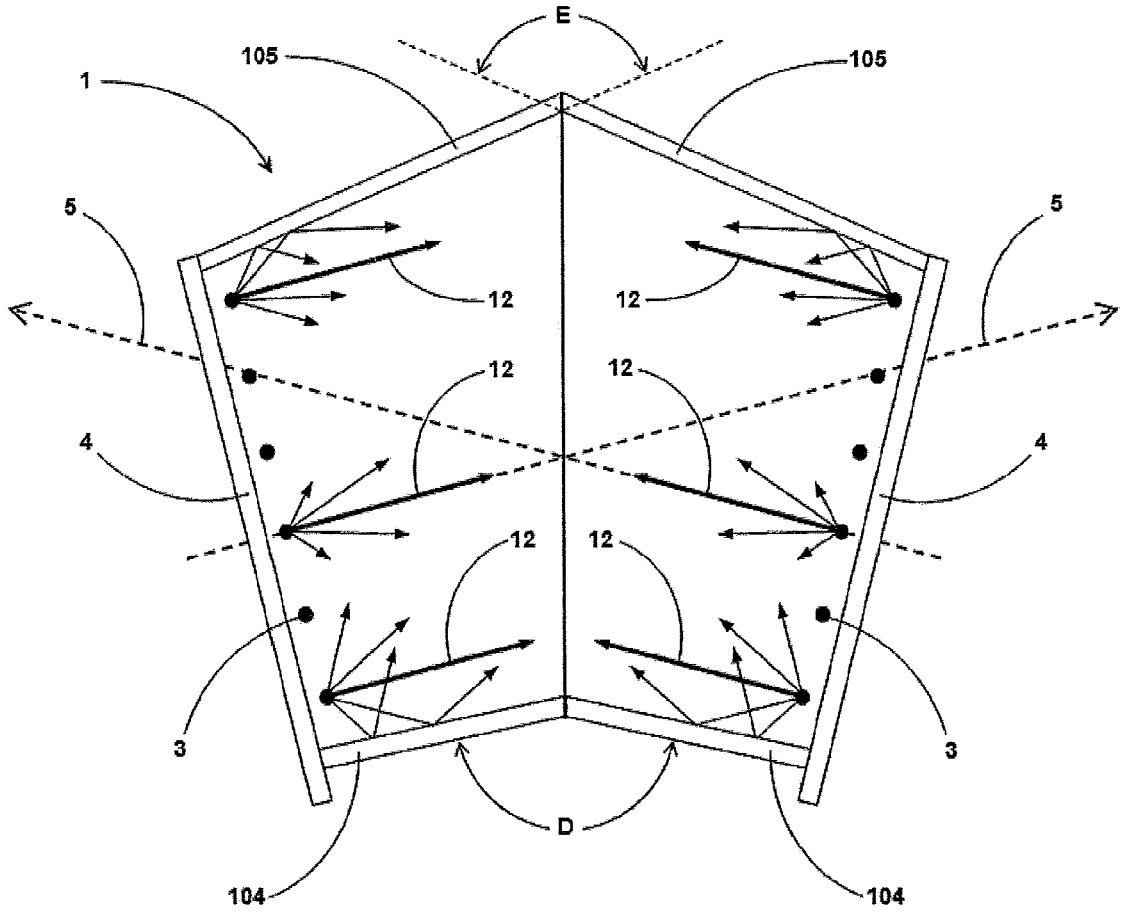
FIG. 8 is a top view of the longitudinal section of the reflector body of the lighting apparatus of the present invention.

FIGS. 6 to 8 show the exemplary reflector embodiment 1 of the lighting apparatus 100 (depicted in FIG. 1A) and a plurality of light sources 3 positioned substantially under the upper section 8 (shown in FIG. 3) and substantially between the rear section 10 (shown in FIG. 4) and the front section 11 (shown in FIG. 5) close to each sidewall 4. A portion of light emitted from said light sources 3 is reflected by the internal surface 2 (indicated in FIG. 1B) of the reflector body 1 in order to direct the reflected light downwards in an efficient manner to provide wide and uniform illumination pattern underneath the lighting apparatus of the present invention.

In FIG. 6, flat sheets 103 of the upper section 8 (shown in FIG. 3) form an upper angle A between them of one hundred and fifty degrees (150°) approximately. However, said angle A may range from one hundred and ten degrees (110°) to one hundred and eighty degrees (180°) depending on the application of the lighting apparatus of the present invention. One or multiple light sources 3 of lambertian type, such as high brightness LEDs, are positioned under each flat sheet 103 close to the adjacent sidewall 4 in a manner that they emit light towards the opposite sidewall 4, whereby light rays having maximum intensity 12 emitted by said light sources 3 are substantially parallel to the reflective surface of the flat sheet 103 under which said light sources 3 are positioned. Therefore, a portion of light emitted from light sources 3 is cutoff upwardly by flat sheets 103 of the upper section 8 (shown in FIG. 3) and is reflected downwards increasing light level on the illuminated area underneath the lighting apparatus, mainly in the first zone 111 (FIG. 2) and in the fourth zone 114 (FIG. 2) of the illumination pattern 107 (FIG. 2), whereby angle A defines the longitudinal range 109 (FIG. 2) of the illumination pattern 107 (FIG. 2). Sheets 103 of the upper section 8 (shown in FIG. 3) may have a small curvature 9 of parabolic form adjacent to each sidewall 4 in order to collimate a small portion of light emitted by light sources 3 so as to increase the amount of light travelling in the direction of the fourth zone 114 (FIG. 2) of the illumination pattern 107 (FIG. 2).

Regarding FIG. 7, flat sheets 104 of the rear section 10 (shown in FIG. 4) and flat sheets 103 of the upper section 8 (shown in FIG. 3) form an angle B between them of ninety degrees (90°) approximately. However, said angle B may range from ninety degrees (90°) to one hundred and fifty degrees (150°) depending on the application of the lighting apparatus of the present invention. As shown in FIG. 7, a portion of light emitted from light sources 3 is cutoff laterally by flat sheets 104 and is reflected towards the front side of the reflector body 1 increasing light level on the illuminated area, mainly in the third zone 113 (FIG. 2) of the illumination pattern 107 (FIG. 2) while also acting as a light blocking shield for preventing excessive illumination in the second zone 112 (FIG. 2) of the illumination pattern 107 (FIG. 2). Also shown in FIG. 7, flat sheets 105 of the front section 11 (shown in FIG. 5) and flat sheets 103 of the upper section 8 (shown in FIG. 3) form an angle C between them of one hundred and ten degrees (110°) approximately. However, said angle C may range from ninety degrees (90°) to one hundred and fifty degrees (150°) depending on the application of the lighting apparatus of the present invention. A portion of light emitted from light sources 3 is cutoff laterally by flat sheets 105 and is reflected downwards increasing light level on the illuminated area underneath the lighting apparatus, mainly in the first zone 111 (FIG. 2) of the illumination pattern 107 (FIG. 2). Therefore, angles B and C define the transversal range 110 (FIG. 2) of the illumination pattern 107 (FIG. 2) and define the shape of the second zone 112 (FIG. 2) and of the third zone 113 (FIG. 2) of the illumination pattern 107 (FIG. 2).

In FIG. 8, flat sheets 104 of the rear section 10 (shown in FIG. 4) form an angle D between them where angle D is approximately one hundred and sixty degrees (160°). However, said angle D may range from one hundred and ten degrees (110°) to one hundred and eighty degrees (180°) depending on the application of the lighting apparatus of the present invention. A portion of light emitted from light sources 3 is cutoff laterally by flat sheets 104 and is reflected towards the front side of the reflector body 1 increasing light level on the illuminated area, mainly in the third zone 113 (FIG. 2) of the illumination pattern 107 (FIG. 2). Also shown in FIG. 8, flat sheets 105 of the front section 11 (shown in FIG. 5) form an angle E between them where angle E is approximately one hundred and twenty degrees (120°). However, said angle E may range from one hundred and ten degrees (110°) to one hundred and eighty degrees (180°) depending on the application of the lighting apparatus of the present invention. A portion of light emitted from light sources 3 is cutoff laterally by flat sheets 105 and is reflected towards the sidewalls 4 increasing light level underneath the lighting apparatus, mainly in the first zone 111 (FIG. 2) and in the fourth zone 114 (FIG. 2) of the illumination pattern 107 (FIG. 2). Therefore, angles D and E define the transversal range 110 (FIG. 2) of the illumination pattern 107 (FIG. 2) and define the shape of the second zone 112 (FIG. 2) and of the third zone 113 (FIG. 2) of the illumination pattern 107 (FIG. 2).

Turning back to FIG. 6, the reflector body 1 and sidewalls 4 are designed in a manner that an angle of approximately ninety degrees (90°) is formed between each flat sheet 103 of the upper section 8 (shown in FIG. 3) and the adjacent sidewall 4, where each sidewall 4 has a normal vector 5 pointing towards the opposite sidewall 4 and towards the fourth zone 114 (FIG. 2) of the illumination pattern 107 (FIG. 2). The normal vector 5 of each sidewall 4 is substantially parallel to the adjacent flat sheet 103 of the upper section 8 (shown in FIG. 3) and therefore substantially parallel to light rays having maximum intensity 12 emitted by light sources 3 positioned close to said sidewall 4. This also can be seen in FIG. 8 whereby normal vector 5 of each sidewall 4 is pointing towards the opposite sidewall 4 and towards the fourth zone 114 (FIG. 2) of the illumination pattern 107 (FIG. 2). The normal vector 5 of each sidewall 4 is substantially parallel to light rays having maximum intensity 12 emitted by light sources 3 positioned close to said sidewall 4. This configuration permits sidewalls 4 to be used as mechanical support for light sources 3 such as complete LED modules 118 (shown in FIG. 10) as will be described later in this document.

The exemplary configuration of the reflector body 1 shown in FIGS. 6 to 8 is particularly interesting for roadway illumination where most of the light has to be concentrated on the road and in front of the lighting apparatus 100 (FIG. 2) so as to illuminate the opposite sidewalk 117 (FIG. 2) and only small portion of light is required for illuminating the near sidewalk 116 (FIG. 2) behind the lighting apparatus 100 (FIG. 2). Using this configuration it is possible to achieve an asymmetric light distribution required for roadway illumination. However, the exemplary configuration of the reflector body 1 shown in FIGS. 6 to 8 is not intended for limiting the scope of present invention, and other configurations of the reflector body 1 are possible for different applications of the lighting apparatus of present invention.

Figure 9:
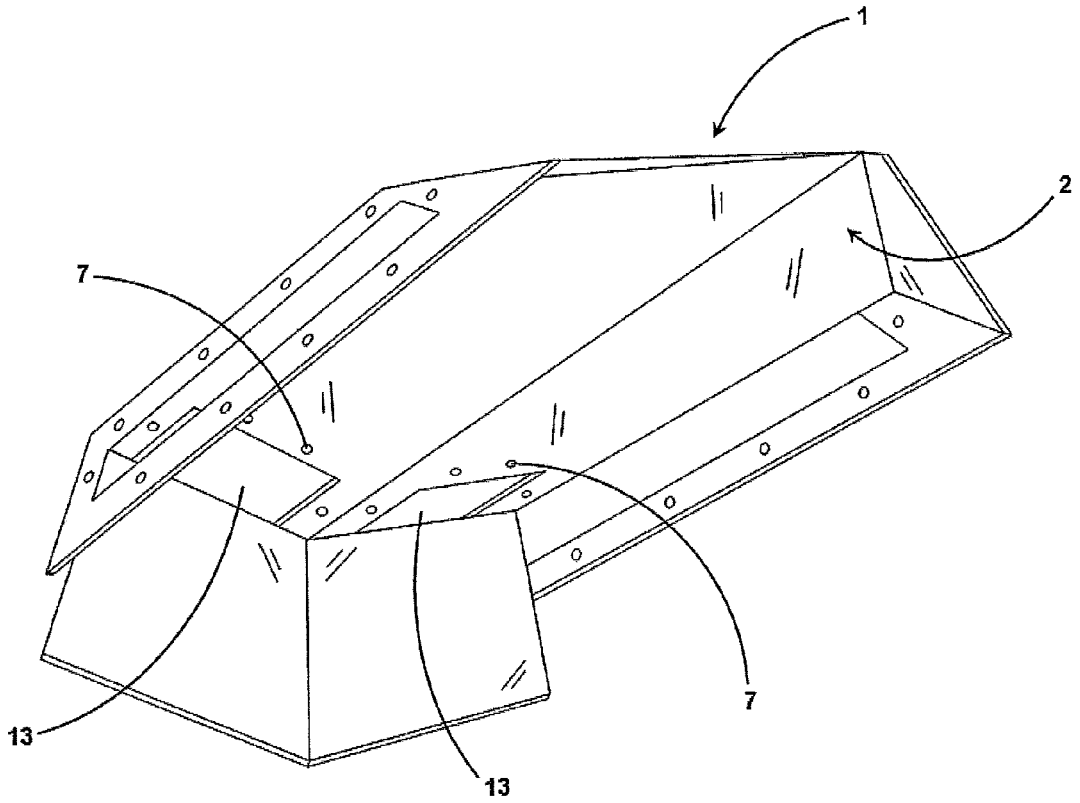
FIG. 9 is a bottom perspective view of the reflector embodiment for the lighting apparatus of the present invention whereby said reflector embodiment has openings in the upper section.

In FIG. 9 an exemplary embodiment of the reflector 1 is shown where each flat sheet 103 (shown in FIG. 3) of the upper section 8 (also shown in FIG. 3) has an opening 13 and multiple perforations 7 in order to insert and attach light sources near the rear section 10 (shown in FIG. 4) and near the upper section 8 (shown in FIG. 3) of the internal surface 2 of the reflector body 1. Light sources inserted through the openings 13 and attached in this manner help to increase light intensity of the first zone 111 (FIG. 2) and the third zone 113 (FIG. 2) of the illumination pattern 107 (FIG. 2).

Figure 10:
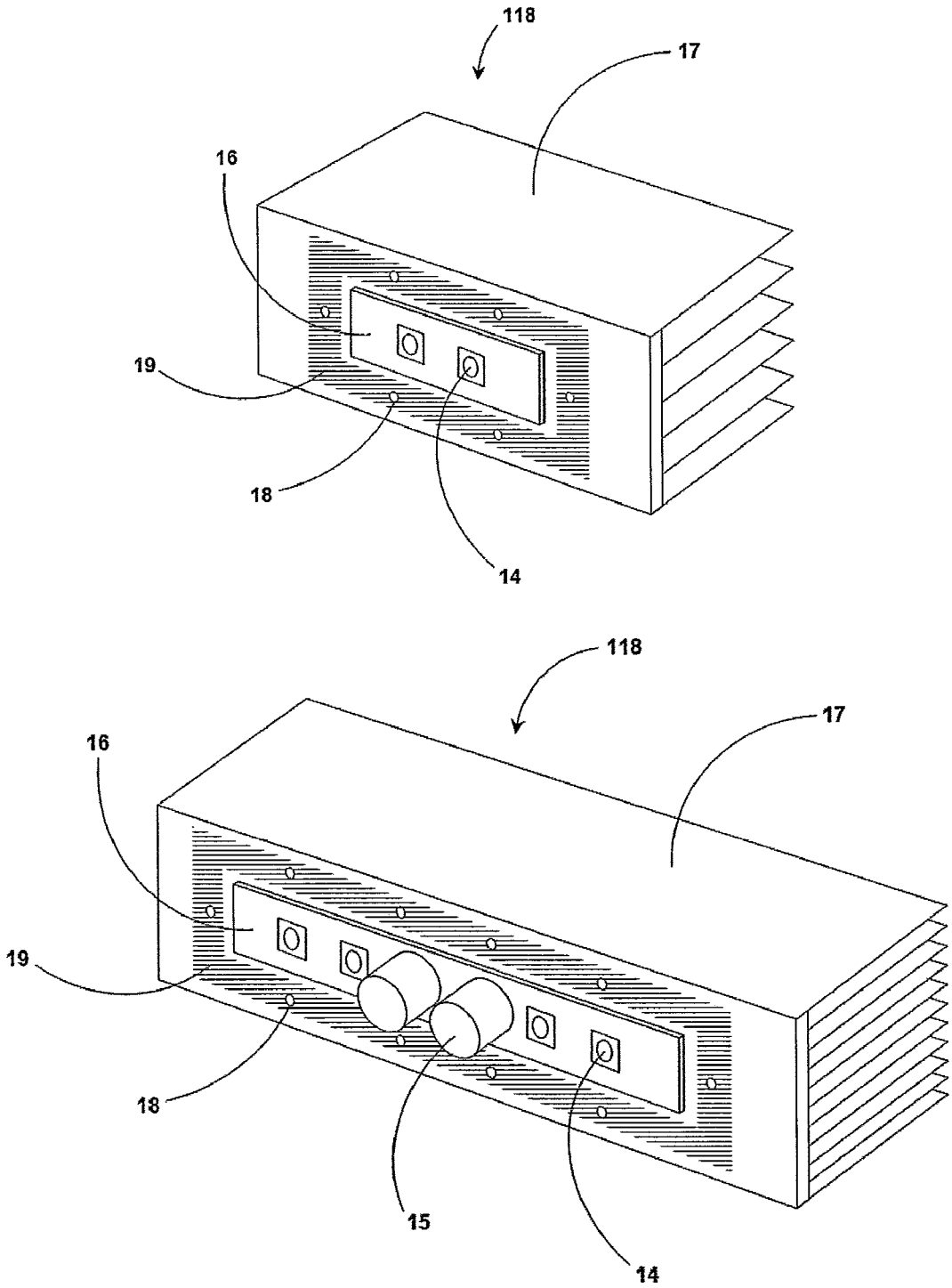
FIG. 10 is a perspective view of the LED modules for the lighting apparatus of the present invention shown in FIG. 1A.

Turning now to FIG. 10, an exemplary modules 118 of light sources which can be used for the lighting apparatus of present invention are shown. Each module 118 comprises one or multiple light sources which can be LEDs 14, whereby one or multiple light sources 3 (shown in FIGS. 6 to 8) may include secondary optics 15 for collimating light emitted from said light sources. In case LEDs 14 are used as light sources, a PCB (printed circuit board) 16 and a heatsink 17 can be integrated into each LED module 118. Practically any type of LED 14 with a lambertian light distribution can be used for the lighting apparatus 100 (shown in FIG. 1A) without the need of modifying the reflector geometry to produce similar illumination patterns between different LEDs, giving an advantage to the present invention. Usually high brightness LEDs 14 are to be used in the lighting apparatus, and because some of them require good thermal dissipation, an MCPCB (metal core printed circuit board) may be used instead of a normal PCB between LEDs 14 and the heatsink 17. Some LEDs 14 do not require to be soldered to a circuit board, and can be attached directly to the heatsink 17 using appropriate methods such as screws or special adhesives. In case that PCB or MCPCB is not used, LEDs 14 must be interconnected with cables to provide electrical current for powering them. As shown in FIG. 10, multiple perforations 18 in the heatsink 17 are made, whereby said perforations 18 are aligned with perforations 7 of sidewalls 4 (shown in FIG. 1B) or with perforations 7 of sheets 103 (depicted in FIG. 9) in order to attach the complete modules 118 to sidewalls 4 (shown in FIG. 1B) or to sheets 103 (shown in FIG. 3) of the reflector body 1 (FIG. 9) using screws. A gasket 19 may be used in LED modules 118 in order to prevent the entrance of undesired particles such as dust and humidity into the enclosure 101 (FIG. 1A) and the reflector body 1 (FIG. 1A) of the lighting apparatus 100 (FIG. 1A).

Secondary optics 15, such as commercially available lenses and reflectors, can be used with one or multiple light sources 3 (shown in FIGS. 6 to 8) of the lighting apparatus of present invention in order to improve the illumination pattern 107 (FIG. 2) produced by said lighting apparatus. Said secondary optics 15 work by collimating a portion of the light emitted by light sources 3 (FIGS. 6 to 8) and amplifying the light travelling in direction of normal vectors 5 (shown in FIGS. 6 and 8) therefore increasing light intensity at the illuminated target mainly in the fourth zone 114 (FIG. 2) of the illumination pattern 107 (FIG. 2). Secondary optics 15 may contribute to the uniformity of the illumination pattern 107 (FIG. 2) and increase the longitudinal range 109 (FIG. 2) of said light pattern 107 (FIG. 2) produced by the lighting apparatus of the present invention.

Figure 11:
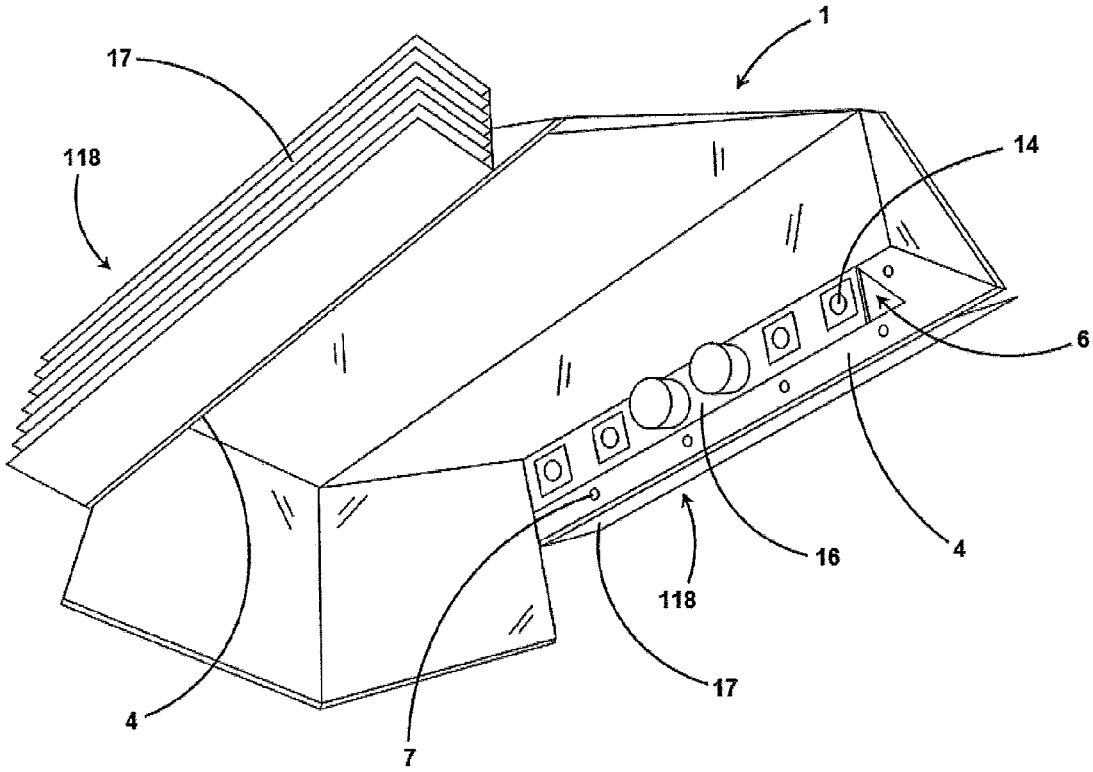
FIG. 11 is a bottom perspective view of the reflector embodiment for the lighting apparatus of the present invention with attached LED modules like the ones shown in FIG. 10.

FIG. 11 shows the exemplary reflector body 1 with attached LED modules 118 to the sidewalls 4. LEDs 14 of each module 118 soldered on a PCB 16 are inserted through openings 6 in the sidewalls 4, whereby said LEDs 14 are positioned inside the reflector body 1 substantially under the upper section 8 (shown in FIG. 3) and between the rear section 10 (shown in FIG. 4) and the front section 11 (shown in FIG. 5). Heatsinks 17 of the LED modules 118 are located outside the reflector body 1 for better thermal dissipation. LED modules 118 can be attached with screws to the reflector body 1 using perforations 7 in the sidewalls 4 and perforations 18 (FIG. 10) in the heatsinks 17. The configuration of the reflector body 1 with attached LED modules 118 of LEDs 14 shown in FIG. 11 has a similar configuration as the reflector body 1 and light sources 3 depicted in FIGS. 6 to 8.

Figure 12A:
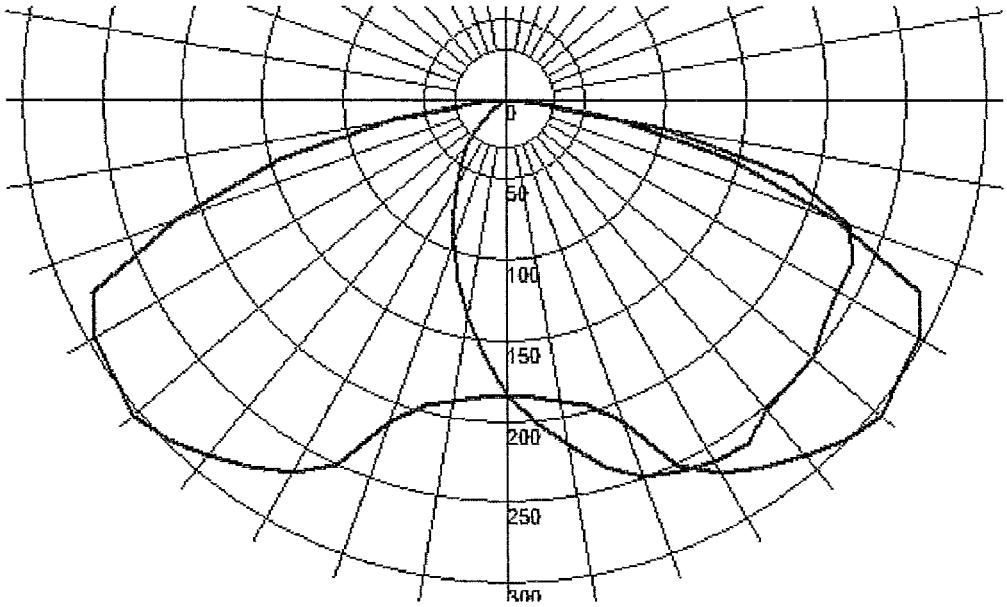
FIGS. 12A and 12B are diagrams of light distribution curves produced by the lighting apparatus of the present invention whereby said lighting apparatus uses LEDs as light sources.
Figure 12B:
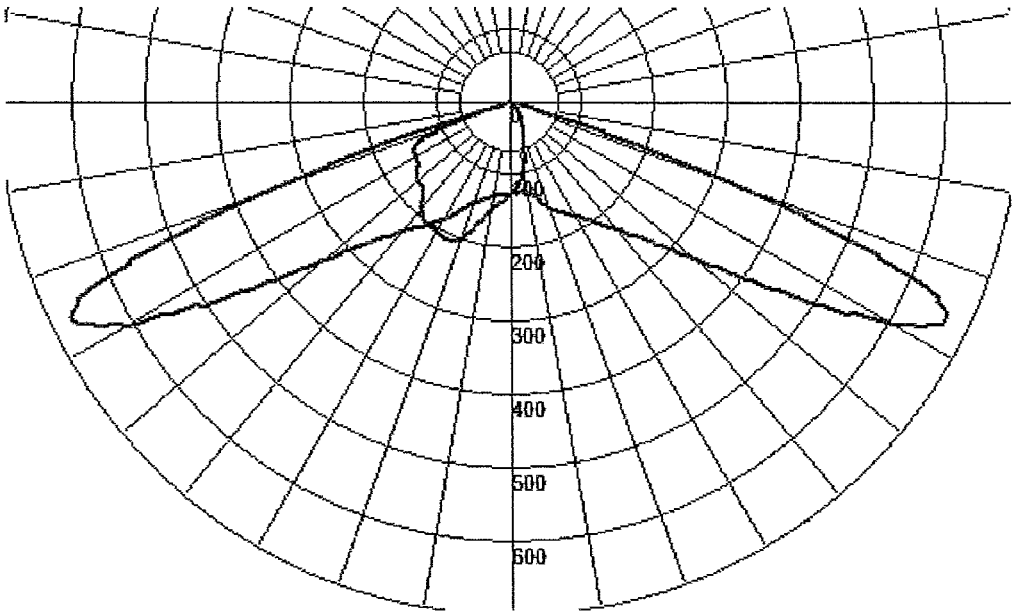

FIGS. 12A and 12B show light distribution curves produced by the lighting apparatus of the present invention using LEDs as light sources. FIG. 12A is a graphical representation of a light distribution curve produced when none of the light sources of the lighting apparatus use secondary optics. FIG. 12B is a graphical representation of a light distribution curve produced when certain light sources of the lighting apparatus use commercially available secondary optics for collimating a portion of light emitted by said light sources in direction of the normal vectors 5 (shown in FIGS. 6 and 8). As can be clearly seen, lighting apparatus with light distribution curve shown in FIG. 12B will produce a wider illumination pattern.

Figure 13:
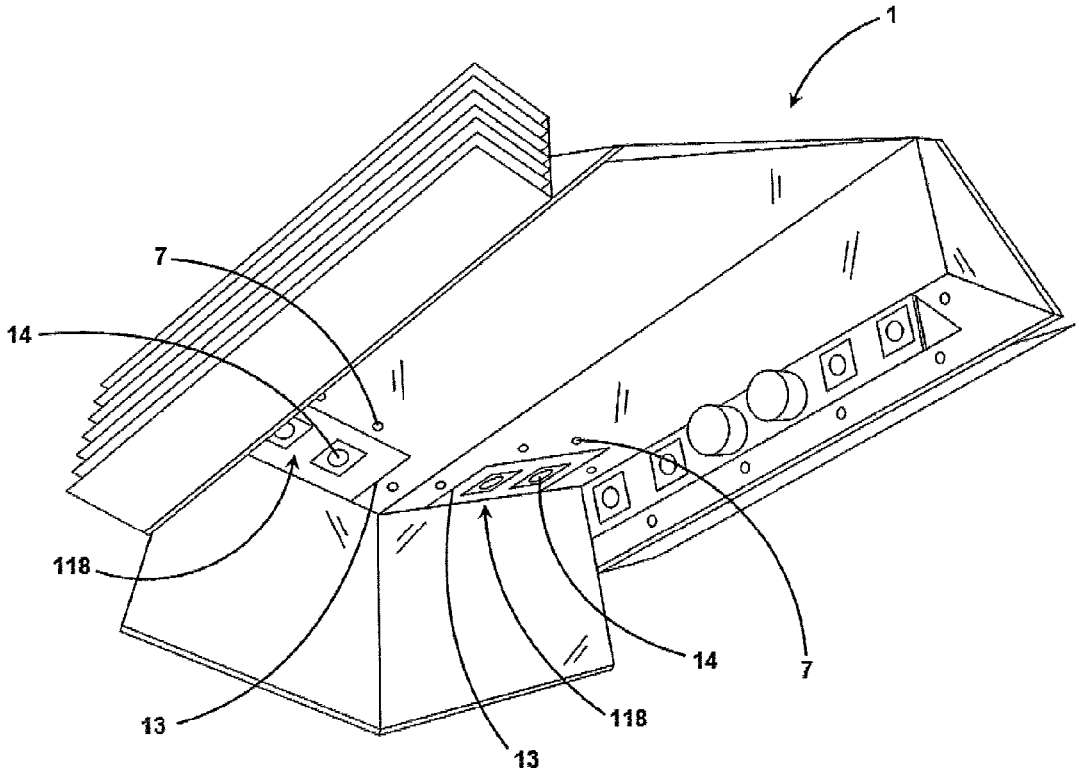
FIG. 13 is a bottom perspective view of the reflector embodiment shown in FIG. 9 with attached LED modules.

FIG. 13 shows the exemplary reflector body 1 with attached LED modules 118 to flat sheets 103 (shown in FIG. 3) of the upper section 8 (also shown in FIG. 3). LEDs 14 of each module 118 are inserted through openings 13 in the upper section 8 (shown in FIG. 3) of the reflector body 1, whereby said LEDs 14 are positioned inside the reflector body 1 substantially under the upper section 8 (shown in FIG. 3) and substantially between the sidewalls 4 close to the rear section 10 (shown in FIG. 4). Heatsinks of said LED modules 118 are located outside the reflector body 1 for better thermal dissipation. LED modules 118 can be attached with screws to the reflector body 1 using perforations 7 in flat sheets 103 (shown in FIG. 3) of the upper section 8 (shown in FIG. 3) and perforations 18 (shown in FIG. 10) in the heatsinks of said LED modules 118.

Figure 14:
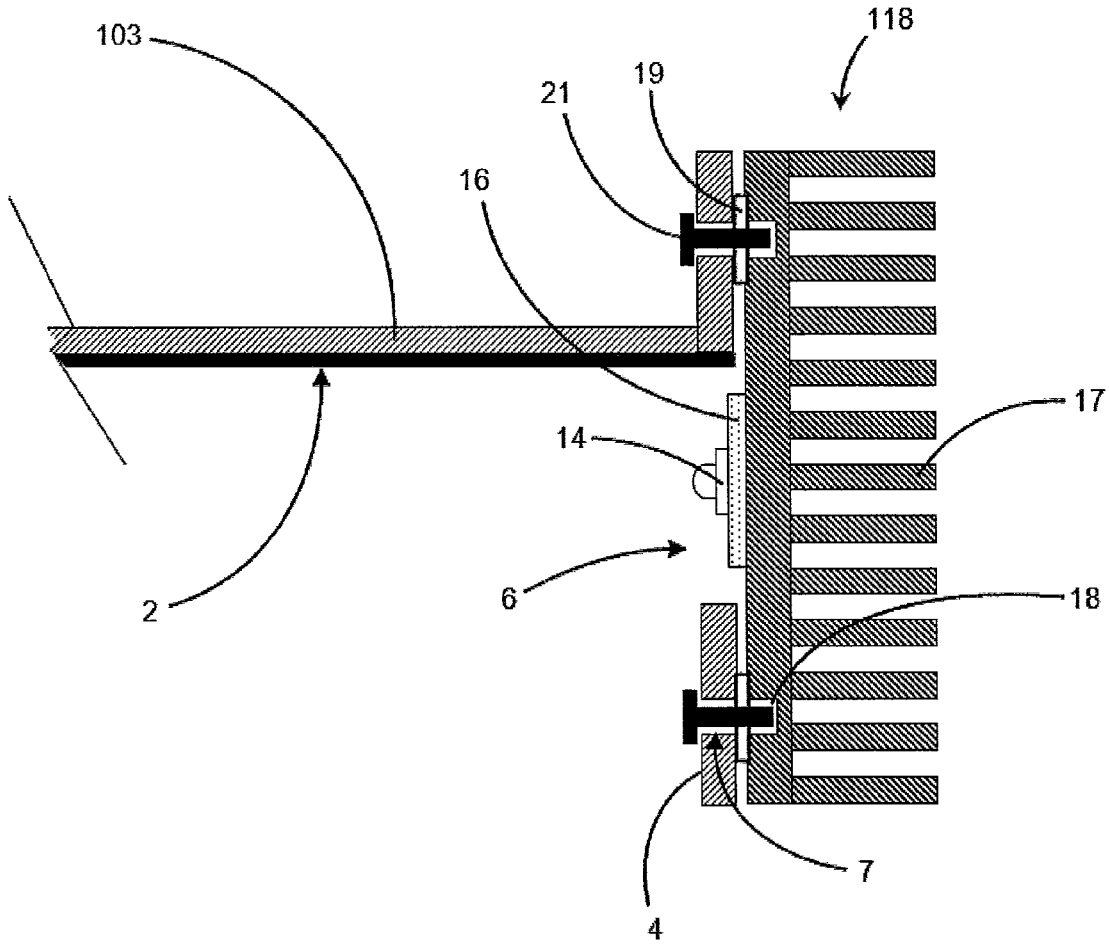
FIGS. 14 to 16 are a cut-away cross-sectional views of one side of the reflector body of the lighting apparatus of the present invention.

In FIG. 14, a cross section of the right side of the reflector body 1 (shown in FIG. 1B) of the lighting apparatus of present invention is shown. A LED module 118 is attached to the sidewall 4 using screws 21 whereby said screws 21 go through perforations 7 in sidewall 4 and are screwed to the heatsink 17 using perforations 18 in said heatsink 17. A PCB (or MCPCB) 16 is attached to the heatsink 17 whereby said PCB (or MCPCB) 16 has one or multiple LEDs 14 disposed on it. The PCB (or MCPCB) 16 with disposed on it LEDs 14 is inserted into the reflector body 1 (FIG. 1B) through the opening 6 in the sidewall 4 whereby said LEDs 14 are positioned substantially under the flat sheet 103 of the upper section 8 (shown in FIG. 3) of the reflector body 1 (FIG. 3). A gasket 19 is sandwiched between the heatsink 17 and the sidewall 4 preventing humidity and other particles from entering into the reflector body 1 (FIG. 1B) and the enclosure 101 (FIG. 1A) of the lighting apparatus 100 (FIG. 1A).

Figure 15:
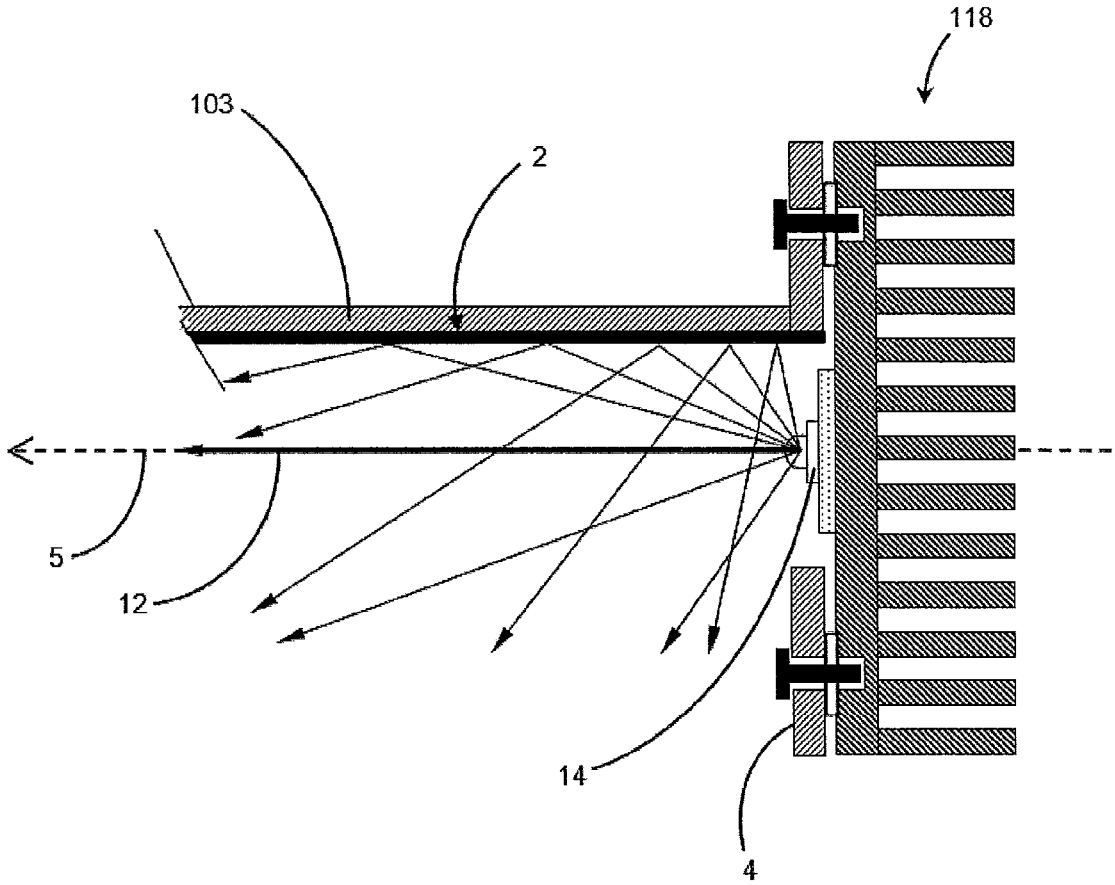

Turning to FIG. 15, a cross section of the right side of the reflector body 1 (shown in FIG. 1B) of the lighting apparatus of present invention is shown. A portion of light emitted by LED 14 or multiple LEDs is received by the internal surface 2 of the reflector body 1 (FIG. 1B) and is reflected downwards. The normal vector 5 of the sidewall 4 is substantially parallel to the flat sheet 103 of the upper section 8 (shown in FIG. 3) and is perpendicular to the surface of the heatsink 17 on which the LED 14 is disposed, whereby light rays with maximum intensity 12 emitted by said LED 14 are substantially parallel to the normal vector 5 of the sidewall 4 so as to illuminate the fourth zone 114 (FIG. 2) of the illumination pattern 107 (FIG. 2).

Figure 16:
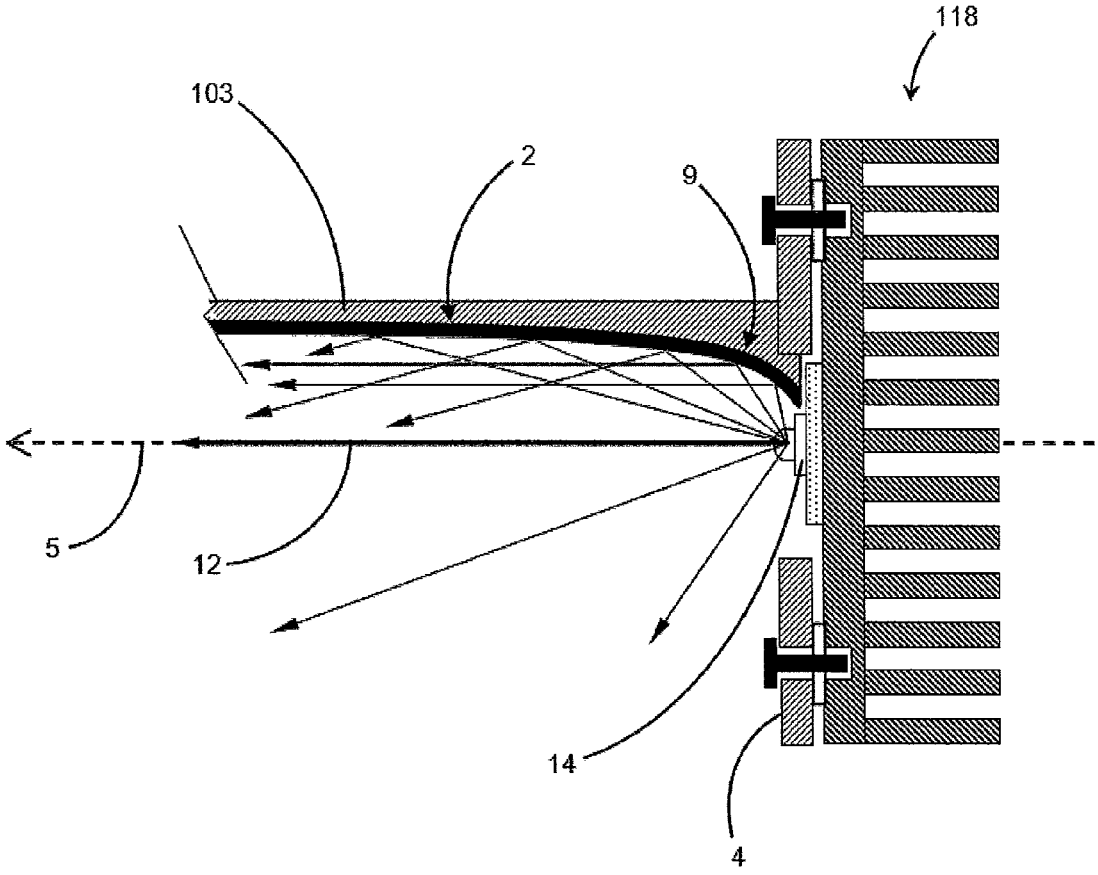

In FIG. 16, a cross section of the right side of the reflector body 1 of the lighting apparatus of present invention is shown. Sheet 103 of the upper section 8 (shown in FIG. 3) have a small curvature 9 of parabolic form so as to collimate a small portion of light emitted by LED 14 or multiple LEDs, whereby collimated light is substantially parallel to the normal vector 5 of sidewall 4 so as to amplify the light travelling in direction of fourth zone 114 (FIG. 2) of the illumination pattern 107 (FIG. 2).

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A lighting apparatus comprising:

at least one pair of flat sidewalls positioned opposing to each other;

a reflector body positioned substantially between the pair of sidewalls, the reflector body having an internal light reflective surface including an upper section, a rear section and a front section; the upper section formed with at least one pair of flat sheets facing downwards positioned at the top of the reflector body, whereby the flat sheets of the upper section form an upper angle between them ranging from about one hundred and ten degrees (110°) to about one hundred and eighty degrees (180°); the rear section formed with at least one pair of flat sheets facing frontwards positioned substantially under the upper section, whereby the flat sheets of the rear section form an external angle between them ranging from about one hundred and ten degrees (110°) to about one hundred and eighty degrees (180°), wherein each of the flat sheets of the rear section and a respective adjacent flat sheet of the upper section form an internal angle between them ranging from about ninety degrees (90°) to about one hundred and fifty degrees (150°); the front section formed with at least one pair of flat sheets facing rearwards positioned substantially under the upper section, wherein the flat sheets of the front section form an internal angle between them ranging from about one hundred and ten degrees (110°) to about one hundred and eighty degrees (180°), wherein each of the flat sheets of the front section and a respective adjacent flat sheet of the upper section form an internal angle between them from about ninety degrees (90°) to about one hundred and fifty degrees (150°); and at least one light source positioned on or substantially close to each sidewall, wherein a portion of light emitted by the light source is cutoff upwardly by at least one flat sheet of the upper section and is reflected downwards so as to increase light level on the illuminated area and wherein a portion of light emitted by said light source is cutoff laterally by at least one of: (1) at least one flat sheet of the rear section and (2) at least one flat sheet of the front section and is reflected so as to increase light level on the illuminated area.

2. A lighting apparatus of claim 1, wherein at least one flat sheet of the upper section of the reflector body has a curvature of a substantially parabolic shape adjacent to a respective sidewall so as to collimate a portion of light emitted by at least one light source.

3. A lighting apparatus of claim 1, wherein each sidewall has at least one opening and multiple perforations in order to insert and attach mechanically at least one light source on or substantially close to the sidewall inside the lighting apparatus of the present invention.

4. A lighting apparatus of claim 3, wherein at least one pair of the flat sheets of the upper section has at least one opening and multiple perforations formed in each flat sheet of the pair in order to insert and attach mechanically at least one light source on or substantially close to the flat sheet of the upper section inside the lighting apparatus of the present invention.

5. A lighting apparatus of claim 1, wherein the at least one light source has secondary optics.

6. A lighting apparatus of claim 3, wherein the at least one light source has secondary optics.

7. A lighting apparatus of claim 4, wherein the at least one light source has secondary optics.

8. A lighting apparatus of claim 3, wherein the at least one light source comprises at least one Light Emitting Diode (LED).

9. A lighting apparatus of claim 1, wherein the at least one light source comprises of at least one Light Emitting Diode (LED).

10. A lighting apparatus of claim 8, wherein the at least one Light Emitting Diode (LED) is positioned on a Printed Circuit Board (PCB), the Printed Circuit Board (PCB) being introduced into the reflector body through the openings formed in said sidewalls, the Printed Circuit Board (PCB) being mounted on a heatsink.

11. A lighting apparatus of claim 9, wherein the at least one Light Emitting Diode (LED) is positioned on a Printed Circuit Board (PCB), the Printed Circuit Board (PCB) being introduced into the reflector body through the openings formed in the sidewalls and wherein the Printed Circuit Board (PCB) is mounted on a heatsink.

* * * * *